US005716768A

United States Patent [19]

Maruyama et al.

[11] Patent Number: 5,716,768

[45] Date of Patent: Feb. 10, 1998

[54] SILVER HALIDE COLOR PHOTOGRAPHIC MATERIAL

[75] Inventors: Yoichi Maruyama; Toshihiro Nishikawa; Nobuyuki Haraguchi, all of Minami-ashigara, Japan

[73] Assignee: Fuji Photo Film Co., Ltd., Kanagawa, Japan

[21] Appl. No.: 804,143

[22] Filed: Feb. 20, 1997

[30] Foreign Application Priority Data

Feb. 20, 1996 [JP] Japan ..... 8-031842

[51] Int. Cl.[6] ..... G03C 1/815

[52] U.S. Cl. ..... 430/512; 430/507; 430/510

[58] Field of Search ..... 430/507, 510, 430/512

[56] References Cited

U.S. PATENT DOCUMENTS 4,956,269 9/1990 Ikeda et al. ..... 430/505

5,081,008 1/1992 Deguchi ..... 430/507

5,578,435 11/1996 Ihama ..... 430/510

5,609,999 3/1997 Aida et al. ..... 430/510

*Primary Examiner*—Hoa Van Le

[57] ABSTRACT

A silver halide color photographic material comprising a plurality of light-sensitive layers having different spectral sensitivities, wherein two nearest light-sensitive layers interposing a light-insensitive layer containing colloidal silver each contains in the proportion of 50% or more (of the projected area) of tabular grains having an aspect ratio of from 3 to 100 and 10 or more dislocation lines per one grain, and a light-insensitive layer is provided between each of the light-sensitive layers and the light-insensitive layer containing colloidal silver.

7 Claims, No Drawings

SILVER HALIDE COLOR PHOTOGRAPHIC MATERIAL

FIELD OF THE INVENTION

The present invention relates to a silver halide color photographic material which is superior in sharpness and reduced replenishing rate processing suitability.

BACKGROUND OF THE INVENTION

Color photographic materials, in particular, color reversal photographic materials which are often used by professional cameramen are frequently utilized as originals for printing. Further, with the progress of digital techniques in recent years, various image processing techniques have been comparatively easily available, and a case in which trimmed small originals are enlarged has been increased even in comparatively inexpensive printings.

In such circumstances, a color reversal photographic material having high image quality, in particular, a material excellent in sharpness has been increasingly demanded in recent years.

Techniques for improving sharpness by making use of tabular emulsions to reduce light scattering are disclosed, for example, in U.S. Pat. Nos. 4,434,226 and 4,439,520. Tabular emulsions are certainly effective to improve sharpness but colloidal silver is generally used in usual color photographic materials for photographing as the intrinsic absorption filter of silver halide. As a typical example, colloidal silver is generally used to cut the intrinsic sensitivities of the emulsions of a green-sensitive layer and a red-sensitive layer by providing a yellow filter layer nearer than a blue-sensitive layer unit from the support and farther than layer units having other spectral sensitivities from the support. The present inventors have examined the development of a photographic material using a tabular emulsion for the improvement of sharpness, however, a new problem has arisen such that if a tabular emulsion is present in a layer adjacent to the layer in which colloidal silver is contained, fog (generally called contact fog) is generated during storage of the photographic material with the lapse of time.

To cope with this problem, we have investigated methods of using organic dyes in place of colloidal silver, for example, methods of using a dissociated anionic dye with a cationic hydrophilic polymer in the same layer to localize the dye as disclosed in U.S. Pat. Nos. 2,548,564, methods of using a water-insoluble solid dye as disclosed in JP-A-56-12639 (the term "JP-A" as used herein means an "unexamined published Japanese patent application"), JP-A-55-155350, JP-A-63-27838, JP-A-63-197943, JP-A-4-31851, European Patents 15601, 274723, 276566, 299435, and WO 88/04794. Contact fog could be certainly reduced by these methods but various problems arose such that decoloring at development processing was insufficient, and unwanted absorption remained after processing, minimum density of the image increased, and color balance failure, which was presumably due to diffusion of the dye to other layers during storage of the photographic material, occurred.

As described above, the development of the technique for the development of a color photographic material which is superior in sharpness and generates less fog during storage with aging is not sufficient under present conditions.

SUMMARY OF THE INVENTION

Accordingly, an object of the present invention is to provide a silver halide color photographic material which is superior in sharpness, generates less fog during storage with the lapse of time, and excellent in processing stability.

The above object of the present invention has been attained by the following means:

(1) A silver halide color photographic material comprising a plurality of light-sensitive layers having different spectral sensitivities, wherein two nearest light-sensitive layers interposing a light-insensitive layer containing colloidal silver each contains in the proportion of 50% or more (of the projected area) of tabular grains having an aspect ratio of from 3 to 100 and 10 or more dislocation lines per one grain, and a light-insensitive layer is provided between each of said light-sensitive layers and the light-insensitive layer containing colloidal silver.

(2) The silver halide color photographic material described in (1), wherein said layer containing colloidal silver is a filter layer which absorbs the light of 450 nm or less wavelength.

(3) The silver halide color photographic material described in (2), wherein any light-sensitive layer farther from the support than said layer containing colloidal silver contains in the proportion of 50% or more (of the projected area) of tabular grains having an aspect ratio of from 3 to 100 and 10 or more dislocation lines per one grain.

(4) The silver halide color photographic material described in (3), wherein the total film thickness of the light-sensitive layers and the light-insensitive layers farther from the support than said layer containing colloidal silver is 10 μm or less (preferably 3 to 10 μm).

DETAILED DESCRIPTION OF THE INVENTION

The grain size of the tabular silver halide grain according to the present invention is expressed by a projected area diameter. Herein, a projected area diameter means the diameter of a circle having the equal area to the projected area of the grain (i.e., equivalent-circle average grain size).

The size of the silver halide grain according to the present invention is preferably from 0.1 μm to 5.0 μm, more preferably from 0.2 μm to 2.0 μm, and most preferably from 0.2 μm to 0.7 μm.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms but twin crystal plane tabular grains are most preferred.

The tabular grains account for preferably 50% or more and particularly preferably 80% or more of the entire projected area of the emulsion layer.

Further, grains of the emulsion according to the present invention preferably have dislocation lines. The dislocation lines of tabular grains can be observed directly with the transmission type electron microscope at low temperature as disclosed, for example, in J. F. Hamilton, *Phot. Sci. Eng.*, 11, 57 (1967) and T. Shiozawa, *J. Soc. Phot. Sci. Japan*, 35, 213 (1972). That is, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout). At this time, the thicker the thickness of the grain, the more difficult is the electron beam to be transmitted. Accordingly, it is preferred to use a high pressure type electron microscope (200 kV or more with the grains of the thickness of 0.25 μm) for observing clearly. When viewed from the vertical direction to the major faces of the grain by the photograph of the grains obtained as described above, the place and the number of dislocation lines with respect to each grain can be obtained.

The number of dislocation lines is preferably 10 or more per one grain on an average, more preferably 20 or more. In the case where dislocation lines exist densely or when dislocation lines are observed mingling with each other, the number of dislocation lines sometimes cannot be counted rightly. However, even in such a case, it is feasible to count roughly such as about 10, about 20, about 30, and can be clearly distinguished from the case where there are only several. The average number of dislocation lines per one grain is obtained as the number average by counting the number of dislocation lines of 100 grains or more.

Dislocation lines can be introduced, for example, in the vicinity of the periphery of a tabular grain. In this case, dislocation lines are almost vertical to the periphery. Dislocation line originates from the position of x % of the length of the distance from the center to the periphery of a tabular grain and leads to the periphery. This x value is preferably 10 or more and less than 100, more preferably 30 or more and less than 99, and most preferably 50 or more and less than 98. At this time, the shape formed by linking these positions where dislocation lines originate is near the like figure of the shape of a grain but not the complete like figure and is sometimes distorted. These types of dislocation lines are not seen in the central region of a grain. The directions of these dislocation lines are about {211} directions crystallographically, but they are sometimes snaking or mingling with each other.

A tabular grain may have dislocation lines on the entire periphery almost uniformly, or may have dislocation lines locally on the periphery. That is, taking a hexagonal tabular silver halide grain as an example, dislocation lines may be limited to be introduced only in the vicinity of six vertexes, or may be limited to only the vicinity of one vertex. On the contrary, it is possible to limit the introduction of dislocation lines only to the sides exclusive of the vicinity of six vertexes.

Further, dislocation lines may be formed over the region inclusive of the center part of two major faces parallel to each other of a tabular grain. When dislocation lines are formed over the entire region of the major faces, when viewed from the vertical direction to the major faces of the grain, the directions of these dislocation lines are sometimes about {211} directions crystallographically, but there are other cases such as in which the directions of dislocation lines are {110} directions or formed at random. Further, the length of each dislocation line is also variously different and there are a case where dislocation lines are observed on the major faces as short lines and a case where dislocation lines are observed as long lines arriving at the side (periphery). Dislocation lines are sometimes straight lines and sometimes snaking. Further, in many cases, they are mingling with each other.

As described-above, positions of dislocation lines may be limited to the periphery, major faces or local positions, or may be formed in combinations of these. That is, they may be present on the periphery and major faces at the same time.

Dislocation lines can be introduced to the periphery of a tabular grain by providing a specific high silver iodide content layer in the interior of the grain. Here, a high silver iodide content layer includes the case of providing high silver iodide content regions discontinuously. Specifically, a grain as a substrate is prepared, then a high silver iodide content layer is provided on the substrate grain and the outside thereof is covered with a layer having a lower iodide content than that of the high silver iodide content layer. The silver iodide content of the substrate tabular grain is lower than that of the high silver iodide content layer, preferably from 0 to 20 mol % and more preferably from 0 to 15 mol %.

A high silver iodide content layer of the interior of a grain means a silver halide solid solution containing silver iodide. In this case, silver iodide, silver iodobromide, or silver chloroiodobromide is preferred as silver halide, but silver iodide or silver iodobromide (a silver iodide content: from 10 to 40 mol %) is more preferred. This high silver iodide content layer of the interior of a grain (hereinafter referred to as an internal high silver iodide content layer) can be selectively provided on either the side or the corner of the substrate grain by controlling the growing conditions of the substrate grain and the growing conditions of the internal high silver iodide content layer. As the growing conditions of the substrate grain, pAg (a logarithm of a reciprocal of the silver ion concentration), the presence or absence, the kind and the amount of a silver halide solvent and the temperature are important factors. If the pAg at the time of growing of the substrate grain is 8.5 or less, preferably 8 or less, the internal high silver iodide content layer can be selectively provided in the vicinity of the vertex of the substrate grain. On the contrary, if the pAg at the time of growing of the substrate grain is 8.5 or more, preferably 9 or more, the internal high silver iodide content layer can be provided on the sides of the substrate grain. These threshold values of pAg are varied up and down by the temperature and the presence or absence, the kind and the amount of a silver halide solvent. When thiocyanate is used as a silver halide solvent, this threshold value of pAg shifts to the higher value. The particularly important pAg at the time of growing is the pAg at the final stage of the growing of the substrate grain. On the other hand, even if the pAg at the time of growing does not satisfy the above values, the selective position of the internal high silver iodide content layer can be controlled by adjusting pAg to the above pAg value after the growth of the substrate grain and ripening. At this time, ammonia, amine compounds, and thiocyanate are effective as a silver halide solvent. For the formation of the internal high silver iodide content layer, a so-called conversion method can be used. As one conversion method, there is a method of adding in the course of grain formation a halide ion having smaller solubility of salt for forming a silver ion than the halide ion which forms the grain or the vicinity of the surface of the grain at that time, but it is preferred in the present invention that the amount of the halide ion having smaller solubility added to the surface area in the course of grain formation should be a certain amount or more (concerned with the halide composition). For example, in the course of grain formation, it is preferred to add a certain amount or more of KI to the surface area of AgBr grain at that time. Specifically, it is preferred to add $8.2\times10^{-5}$ mol/m$^2$ or more of an iodide.

A more preferred forming method of an internal high silver iodide content layer is a method in which the addition of an aqueous solution of halide containing an iodide is conducted at the same time with the addition of an aqueous solution of silver salt.

For example, an aqueous solution of KI is added at the same time with an aqueous solution of $AgNO_3$ by a double jet method. At this time, the starting time and the terminating time of addition of an aqueous solution of KI and those of an aqueous solution of $AgNO_3$ may not be the same. The molar ratio of the addition of an aqueous solution of $AgNO_3$ to an aqueous solution of KI is preferably 0.1 or more, more preferably 0.5 or more, and still more preferably 1 or more. The total addition mol amount of an aqueous solution of $AgNO_3$ to the amount of a halide ion and an iodide ion added in the reaction system may be in the silver excess region. The pAg at the time of the addition of an aqueous solution of halide containing an iodide ion and the addition of an aqueous solution of silver salt by a double jet method is preferably reduced with the progress of the addition time. The pAg before the start of addition is preferably from 6.5 to 13 and more preferably from 7.0 to 11. The pAg at the termination of addition is most preferably from 6.5 to 10.0.

When conducting the above method, the solubility of the silver halide in the reaction mixture is preferably as small as possible. Accordingly, the temperature of the reaction mixture when an internal high silver iodide content layer is formed is preferably from 30° C. to 70° C. and more preferably from 30° C. to 50° C.

The formation of an internal high silver iodide content layer is conducted most preferably by the addition of fine grain silver iodide (fine silver iodide, hereinafter the same), fine grain silver iodobromide, fine grain silver chloroiodide or fine grain silver chloroiodobromide, particularly preferably fine grain silver iodide. The grain size of these fine grains is generally from 0.01 μm to 0.1 μm, but fine grains of the grain sizes of 0.01 μm or less or 0.1 μm or more can also be used. With respect to preparing methods of these fine grain silver halide grains, Japanese Patent Application Nos. 63-7851 (JP-A-1-183417), 63-195778 (JP-A-2-44335), 63-7852 (JP-A-1-183644), 63-7853 (JP-A-1-183645), 63-194861 (JP-A-2-43534) and 63-194862 (JP-A-2-43535) can be referred to. An internal high silver iodide content layer can be provided by adding these fine grain silver halide grains and ripening. After ripening, these fine grains can be dissolved using the above-described silver halide solvent. All of these fine grains added are not necessarily immediately dissolved and vanished, it is sufficient that they should be dissolved when the final grain is completed.

The silver iodide content of the outer layer covering the internal high silver iodide content layer is lower than that of the high silver iodide content layer, preferably from 0 to 30 mol %, more preferably from 0 to 20 mol %, and most preferably from 0 to 10 mol %. This internal high silver iodide content layer preferably exists within the range of from 5 to less than 100 mol %, more preferably from 20 to less than 95 mol %, and particularly preferably within the range of from 50 to less than 90 mol %, based on the silver amount of the entire grain, measured from the center of the hexagon of the projected silver halide grain. The content of the silver halide comprising the internal high silver iodide content layer is 50 mol % or less, more preferably 20 mol % or less, of the silver amount of the entire grain in terms of silver. These contents with respect to the internal high silver iodide content layer are the prescription values of silver halide production and not values obtained by measuring the halide composition of final grains by various analyzing methods. Internal high silver iodide content layers are often vanished through recrystallization process and the like and the above are all concerning the production method thereof.

Accordingly, dislocations lines in the final grain can be observed easily by the above-described method but the internal high silver iodide content layer which is provided for the purpose of introducing dislocation lines cannot be ascertained as a clear layer in many cases, for example, in some cases the entirety of the peripheral region of a tabular grain is observed as a high silver iodide content layer. The halide composition of grains can be confirmed by various methods in combination, for example, x-ray diffraction, an EPMA method (XMA by another name) (a method of scanning a silver halide grain with an electron beam and detecting the silver halide composition), an ESCA method (XPS by another name) (a method of X-raying a grain and spectral-analyzing the photoelectron coming out from the surface of the grain).

The temperature and pAg when the outer layer covering an internal high silver iodide content layer is formed are arbitrary, but the temperature is preferably from 30° C. to 80° C. and most preferably from 35° C. to 70° C., and the pAg is preferably from 6.5 to 11.5. In some cases the above-described silver halide solvents are preferably used. The most preferred silver halide solvent is thiocyanate.

For the introduction of dislocation lines on the major face of a tabular grain, after a grain as a substrate is formed, silver halochloride is deposited on the major face, the silver halochloride is converted to form a high silver bromide or high silver iodide layer, and the outside thereof is covered with a shell. As silver halochloride, silver chloride or silver chlorobromide or silver chloroiodide containing 10 mol % or more, preferably 60 mol % or more, of silver chloride can be cited. Silver halochloride can be deposited on the major face of a substrate grain by the addition of an aqueous solution of silver nitrate and an aqueous solution of appropriate metal salt (e.g., potassium chloride) separately or simultaneously, or also can be deposited by adding emulsions of these silver salts and ripening. The deposition of silver halochloride is feasible at any pAg range but most preferably from 5.0 to 9.5. In this method, a tabular grain grows mainly in the thickness direction. The amount of silver halochloride of this silver halochloride layer is preferably from 1 mol % to 80 mol %, more preferably from 2 mol % to 60 mol %, in terms of silver. Dislocation lines can be introduced on the major face of a tabular grain by converting this silver halochloride layer with an aqueous solution of halide which can produce silver salt having lower solubility than that of silver halochloride. For example, after conversion of the silver halochloride layer with an aqueous solution of KI and growing a shell, the final grain can be obtained. Halide conversion of the silver halochloride layer does not mean that the entire amount of silver halochloride is replaced with silver salt having lower solubility than that of silver halochloride but preferably 5% or more, more preferably 10% or more, and most preferably 20% or more, of silver halochloride is replaced with silver salt having lower solubility. Dislocation lines can be introduced locally on the major face of a tabular grain by controlling the halide composition of the substrate grain on which a silver halochloride layer is provided. For example, when using an internal high silver iodide content substrate grain displaced in the transverse direction from the substrate tabular grain, dislocation lines are feasible to be introduced only on the peripheral major face exclusive of the central part of the major face. Further, when using an external high silver iodide content substrate grain displaced in the transverse direction from the substrate tabular grain, dislocation lines are feasible to be introduced only on the central part of the major face exclusive of the peripheral part. Moreover, by depositing silver halochloride only in a limited area using the locally predominant substance of epitaxial growth of silver halochloride, e.g., an iodide, dislocation lines can be introduced in that part only. The temperature at the time of deposition of silver halochloride is preferably from 30° C. to 70° C., more preferably from 30° C. to 50° C. After the deposition of silver halochloride, conversion is carried out, thereafter a shell can be grown, alternatively, after the deposition of silver halochloride, halide conversion can be conducted simultaneously with carrying out growing of a shell.

The internal silver halochloride layer which is formed almost parallel to major faces preferably exists within the range of from 5 to less than 100 mol %, more preferably from 20 to less than 95 mol %, and particularly preferably within the range of from 50 to less than 90 mol %, based on the silver amount of the entire grain, from the center of the thickness of the grain to both sides.

The term "silver halochloride" is employed in its art recognized usage to designate silver halide grains containing silver ions in combination with chloride ions and at least one of iodide and bromide ions.

The content of silver iodide of the shell is preferably from 0 to 30 mol %, more preferably from 0 to 20 mol %. The temperature and pAg when the shell is formed are arbitrary, but the temperature is preferably from 30° C. to 80° C. and most preferably from 35° C. to 70° C., and the pAg is preferably from 6.5 to 11.5. In some cases the above-described silver halide solvents are preferably used. The most preferred silver halide solvent is thiocyanate. In the final grain, the internal silver halochloride layer subjected to halide conversion cannot be ascertained in some cases by the above-described analyzing method depending on the conversion conditions, such as the degree of conversion or the like, but dislocations lines can be observed clearly.

Dislocation lines can be introduced in combination of this method of introduction on arbitrary positions of the major faces of a tabular grain and the above-described method of introduction on arbitrary positions of the periphery of a tabular grain optionally.

No particular limitation is posed on the halide compositions of the tabular silver halide emulsion according to the present invention but silver iodobromide is particularly preferred.

The average silver iodide content of the silver halide emulsion according to the present invention is preferably 6 mol % or less, more preferably 5 mol % or less, and still more preferably 4.5 mol % or less.

The relative standard deviation of the silver iodide content distribution among grains of the silver halide emulsion according to the present invention is not particularly limited but is preferably 50% or less, more preferably 40% or less.

The silver iodide content of individual emulsion grain can be measured, for example, by analyzing the composition of the grain one by one with an X-ray microanalyzer. "The relative standard deviation of the silver iodide content distribution of individual grain" means the value obtained by measuring the silver iodide content of at least 100 emulsion grains with an X-ray microanalyzer, dividing the standard deviation of the silver iodide content distribution by the average silver iodide content and multiplying 100. The specific method of measuring the silver iodide content of individual emulsion grain is disclosed, for example, in EP-A-147868.

If the relative standard deviation of the silver iodide content distribution of individual grain is large, the optimal point of the chemical sensitization of individual grain is different, therefore, it is impossible to get out the capacities of all emulsion grains, and the relative standard deviation among grains of the number of dislocation lines is also liable to become great.

There are cases in which correlation exists and does not exist between the silver iodide content of individual grain Yi (mol %) and the diameter corresponding to sphere of individual grain Xi (μm) and the case in which correlation does not exist is preferred.

The constitution concerning the halide composition of tabular silver halide grains according to the present invention can be confirmed by various methods in combination, for example, X-ray diffraction, an EPMA method (XMA by another name) (a method of scanning a silver halide grain with an electron beam and detecting the silver halide composition), an ESCA method (XPS by another name) (a method of X-raying a grain and spectral-analyzing the photoelectron coming out from the surface of the grain).

The grain size distribution of the emulsion may be narrow or may be broad, but monodisperse emulsions are preferred for improving graininess.

An aspect ratio is defined as the ratio of the diameter of the circle corresponding to a projected area to the thickness of a grain, and the thickness is the shortest length of the diameter passing the center of gravity of a grain. The aspect ratio of the tabular grain may be 3 to 100, preferably from 5 to 100, and particularly preferably from 5 to 20.

A monodisperse emulsion at least 95% by weight of which have a grain size within ±40% of the average grain size is representative. An emulsion at least 95% by weight of which or at least 95% in terms of number have a grain size within ±25% of the average grain size can be preferably used in the present invention.

A polyvalent metal such as iridium, rhodium or lead can be added to the tabular silver halide emulsion of the present invention during grain formation.

The tabular silver halide emulsion of the present invention can be doped with a thiocyanate ion during grain formation.

The tabular silver halide emulsion according to the present invention can be chemically sensitized. For example, chemical sensitization can be carried out using active gelatin as disclosed in T. H. James, *The Theory of the Photographic Process*, 4th Ed., Macmillan (1977), pp. 67 to 77. Sensitization can also be conducted using sulfur, selenium, tellurium, gold, platinum, palladium, or iridium, or two or more of these sensitizers in combination at pAg of from 5 to 10, pH of from 5 to 8, and temperature of from 30° to 80° C. as disclosed in *Research Disclosure*, Vol. 120, April, 1974, 12008, idib., Vol. 34, June, 1975, 13452, U.S. Pat. Nos. 2,642,361, 3,297,446, 3,772,031, 3,857,711, 3,901,714, 4,266,018 and 3,904,415 and British Patent 1,315,755. Chemical sensitization is conducted optimally in the presence of gold compounds and thiocyanate compounds, and also conducted in the presence of sulfur-containing compounds or hypo, sulfur-containing compounds such as thiourea and rhodanine as disclosed in U.S. Pat. Nos. 3,857,711, 4,266,018 and 4,054,457. Chemical sensitization can be conducted in the presence of an auxiliary chemical sensitizer. The compounds known to inhibit fogging during chemical sensitization and to increase sensitivity such as azaindene, azapyridazine, azapyrimidine, are used as a useful auxiliary chemical sensitizer. Examples of auxiliary chemical sensitizer reformer are disclosed in U.S. Pat. Nos. 2,131,038, 3,411,914, 3,554,757, JP-A-58-126526 and G. F. Duffin, *Photographic Emulsion Chemistry*, pp. 138 to 143.

Chemical sensitization with selenium compounds can preferably be used in the emulsion according to the present invention.

The tabular silver halide emulsion of the present invention can be selenium sensitized according to conventional methods. That is, in general, selenium sensitization is carried out by adding an unstable selenium compound and/or a non-unstable selenium compound to an emulsion and stirring the emulsion for a predetermined period of time at high temperature, preferably at 40° C. or more. The selenium sensitization using unstable selenium sensitizers disclosed in JP-B-44-15748 (the term "JP-B" as used herein means an "examined Japanese patent publication") are preferably used in the present invention. Specific examples of unstable selenium sensitizers include aliphatic isoselenocyanates, e.g., allylisoselenocyanate, selenoureas, seleno ketones, selenoamides, selenocarboxylic acids, seleno esters, and selenophosphates. Particularly preferred unstable selenium compounds are described below.

I. Colloidal Metal Selenium

II. Organic Selenium Compound (selenium atom is double bonded to the carbon atom of an organic compound by covalent bonding)

a. Isoselenocyanates

For example, aliphatic isoselenocyanates such as allylisoselenocyanate.

b. Selenoureas (including an enol type)

For example, aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl, and dimethyl; aliphatic selenourea having one or more aromatic group(s) such as tolyl; and heterocyclic selenourea having a heterocyclic group such as pyridyl and benzothiazolyl.

c. Seleno ketones

For example, selenoacetone, selenoacetophenone, seleno ketone in which an alkyl group is bonded to —C(=Se)—, and selenobenzophenone.

d. Selenoamides

For example, selenoacetamide.

e. Selenocarboxylic acids and seleno esters

For example, 2-selenopropionic acid, 3-selenobutyric acid and methyl-3-selenobutyrate.

III. Others a. Selenides

For example, diethylselenide, diethyldiselenide and triphenylphosphineselenide.

b. Selenophosphates

For example, tri-p-tolylselenophosphate and tri-n-butylselenophosphate.

Preferred types of unstable selenium compounds are described above but they are not limitative. In the unstable type selenium compound as the sensitizer for a photographic emulsion, the structure of the compound is not important for one skilled in the art as long as the selenium is unstable. It is generally understood that the organic moiety of a selenium sensitizer molecule has no role except for carrying selenium and allowing it to be present in an emulsion in an unstable form. Unstable selenium compounds having such a broad idea are advantageously used in the present invention.

Selenium sensitization using the non-unstable selenium compounds disclosed in JP-B-46-4553, JP-B-52-34492 and JP-B-52-34491 is also used in the present invention. Examples of the non-unstable selenium compounds include, e.g., selenious acid, potassium selenocyanide, selenazoles, quaternary ammonium salts of selenazoles, diaryl selenide, diaryl diselenide, 2-thioselenazolidinedione, 2-selenooxazolidinethione, and derivatives thereof.

The non-unstable selenium sensitizer, thioselenazolidinedione compounds disclosed in JP-B-52-38408 are also effectively used in the present invention.

These selenium sensitizers are dissolved in water, or a single or a mixed solvent of an organic solvent such as methanol, ethanol, acetone and added at the time of chemical sensitization. They are preferably added before the start of chemical sensitization other than selenium sensitization. A selenium sensitizer used is not limited to one, and two or more above-described selenium sensitizers can be used in combination. The combined use of unstable selenium compounds and non-unstable selenium compounds is preferred.

The addition amount of a selenium sensitizer for use in the present invention differs depending on the degree of activity of the selenium sensitizer used, the kind and size of the silver halide and the temperature and time of ripening, but is preferably $1\times10^{-8}$ mol or more, more preferably from $1\times10^{-7}$ to $5\times10^{-5}$ mol, per mol of the silver halide. The temperature of chemical ripening when a selenium sensitizer is used is preferably 45° C. or more, more preferably from 50° C. to 80° C.

The pAg during ripening when a selenium sensitizer is used is arbitrary, but is preferably 7.5 or more and more preferably 8.0 or more. The pH is also arbitrary but is preferably 7.5 or less and more preferably 6.8 or less. These preferred conditions may be effective alone but a combination is more preferred.

Selenium sensitization is more advantageously conducted in the presence of a silver halide solvent.

Silver halide solvents which can be used in the present invention include (a) the organic thioethers disclosed in U.S. Pat. Nos. 3,271,157, 3,531,289, 3,574,628, JP-A-54-1019 and JP-A-54-158917, (b) the thiourea derivatives disclosed in JP-A-53-82408, JP-A-55-77737 and JP-A-55-2982, (c) the silver halide solvents having the thiocarbonyl group between an oxygen or sulfur atom and a nitrogen atom disclosed in JP-A-53-144319, (d) the imidazoles disclosed in JP-A-54-100717, (e) sulfite, and (f) thiocyanate. Particularly preferred are thiocyanate and tetramethylthiourea. The amount of the solvent used is varied depending on the kind of the solvent, for example, thiocyanate is preferably used in an amount of from $1\times10^{-4}$ mol to $1\times10^{-2}$ mol per mol of the silver halide.

It is desired for the tabular silver halide grains of the present invention to use sulfur sensitization and/or gold sensitization, in addition to selenium sensitization.

Sulfur sensitization is usually carried out by adding a sulfur sensitizer and stirring the emulsion for a predetermined period of time at high temperature, preferably 40° C. or more.

Gold sensitization is usually carried out by adding a gold sensitizer and stirring the emulsion for a predetermined period of time at high temperature, preferably 40° C. or more.

Known sulfur sensitizers can be used for the above sulfur sensitization, for example, thiosulfate, allyl thiocarbamidothiourea, allyl isothiocyanate, cystine, p-toluenethiosulfonate, and rhodanine. In addition to the above, the sulfur sensitizers disclosed in U.S. Pat. Nos. 1,574,944, 2,410,689, 2,278,947, 2,728,668, 3,501,313, 3,656,955, German Patent 1,422,869, JP-B-56-24937 and JP-A-55-45016 can also be used.

The addition amount of a sulfur sensitizer may be sufficient to effectively increase the sensitivity of the emulsion. The addition amount varies in a considerably wide range according to various conditions such as the pH, temperature and size of silver halide grain but is preferably from $1\times10^{-7}$ mol to $5\times10^{-5}$ mol per mol of the silver halide.

The oxidation number of the gold sensitizers of gold sensitization of the present invention may be monovalent or trivalent and gold compounds usually used as gold sensitizers can be used. Representative examples thereof include chloroaurate, potassium chloroaurate, auric trichloride, potassium auric thiocyanate, potassium iodoaurate, tetracyanoauric acid, ammonium aurothiocyanate, and pyridyl trichloro-gold.

The addition amount of a gold sensitizer varies according to various conditions but is preferably from $1\times10^{-7}$ to $5\times10^{-5}$ mol per mol of the silver halide as a criterion.

When chemical ripening is carried out, the addition time and order of a silver halide solvent and/or a selenium sensitizer and/or a sulfur sensitizer and a gold sensitizer are not particularly limited, for example, these compounds can be added at the same time or differently at early stage of chemical ripening (preferably) or during-chemical ripening is progressing. They are dissolved in water, or a single solution or a mixed solution of an organic solvent miscible with water, e.g., methanol, ethanol, acetone, and added.

The surface or an arbitrary place from the surface of the tabular emulsion according to the present invention may be chemically sensitized but it is preferred that the surface is chemically sensitized. When the interior is chemically sensitized, JP-A-63-264740 can be referred to.

The silver halide emulsion according to the present invention can be reduction sensitized.

The production process of a silver halide emulsion can be classified broadly into processes of grain formation, desalting and chemical sensitization. The grain formation is divided into nucleation, ripening, growing and the like. These processes are not conducted evenly but the order is reversed in some case and one process is conducted repeatedly in another case. Reduction sensitization of silver halide emulsion can be conducted fundamentally at any stage, that is, it may be conducted at nucleation stage which is the early stage of the grain formation, at the stage of physical ripening or grain growth, or prior to chemical sensitization other than reduction sensitization or after this chemical sensitization. When gold sensitization is conducted in combination, reduction sensitization is preferably conducted prior to gold sensitization so as not to generate unwanted fog. The most preferred method is to conduct reduction sensitization during growth of silver halide grains. Herein, "during growth of grains" means to include the method of conducting reduction sensitization in the state when silver halide grains are growing by physical ripening or by the addition of water-soluble silver salt and water-soluble alkali halide, or the method of further growing grains after reduction sensitization is conducted in the state when the growth is stopped temporarily.

The method of the reduction sensitization of the present invention can be selected from a method in which known reduction sensitizers are added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, amines and polyamines, hydrazine derivatives, formamidinesulfinic acid, silane compounds and borane compounds are well known as a reduction sensitizer. These known reduction sensitizers can be selected and used in the present invention, and two or more of these compounds can also be used in combination. Stannous chloride, thiourea dioxide, dimethylamineborane, ascorbic acid and derivatives thereof are preferred compounds as a reduction sensitizer. As the addition amount of the reduction sensitizer depends upon the production conditions of the emulsion, the addition amount needs to be selected, but $10^{-7}$ to $10^{-3}$ mol per mol of the silver halide is preferred.

The reduction sensitizers are dissolved in water or a solvent such as alcohols, glycols, ketones, esters or amides and added during grain growth. They may be previously added to a reaction vessel but is more preferably added at a proper stage during grain growth. Further, the reduction sensitizers have been previously added to an aqueous solution of water-soluble silver salt or an aqueous solution of water-soluble alkali halide and grains can be grown using these aqueous solutions. In addition, the solution of the reduction sensitizers may be divided to several parts and added in several times or may be added continuously with the degree of the grain growth.

The reduction sensitizers are dissolved in water or a solvent such as alcohols, glycols, ketones, esters or amides and added during grain formation, before chemical sensitization or after chemical sensitization. They may be added at any stage of the emulsion production process, but a method of adding during grain growth is particularly preferred. They may be previously added to a reaction vessel but is more preferably added at a proper stage during grain growth. Further, the reduction sensitizers have been previously added to an aqueous solution of water-soluble silver salt or an aqueous solution of water-soluble alkali halide and grains can be grown using these aqueous solutions. In addition, the solution of the reduction sensitizers may be divided to several parts and added in several times or may be added continuously over a long period of time with the degree of the grain growth.

Various compounds can be added to the photographic emulsion of the present invention for preventing generation of fog or stabilizing photographic capacities during production, storage or processing of the photographic material. Such compounds include compounds well-known as an antifoggant or a stabilizer such as azoles, e.g., benzothiazolium salt, nitroindazoles, triazoles, benzotriazoles, benzimidazoles (in particular, nitro- or halogen-substituted); heterocyclic mercapto compounds, e.g., mercaptothiazoles, mercaptobenzothiazoles, mercaptobenzimidazoles, mercaptothiazoles, mercaptotetrazoles (in particular, 1-phenyl-5-mercaptotetrazole), mercaptopyrimidines; the above heterocyclic mercapto compounds having a water-soluble group, e.g., a carboxyl group and a sulfone group; thioketo compounds, e.g., oxazolinethione; azaindenes, e.g., tetraazaindenes (in particular, 4-hydroxy-substituted-(1,3,3a,7)tetraazaindenes); benzenethiosulfonic acid; and benzenesulfinic acid.

These antifoggants or stabilizers are, in general, added after chemical sensitization but they are more preferably added during chemical ripening or before the start of chemical ripening and can be selected optionally. That is, in the silver halide emulsion grain formation process, they may be added at any time during the addition of an aqueous solution of silver salt, during the period of time after the addition of an aqueous solution of silver salt and before the start of chemical ripening, or during chemical ripening (preferably within 50% of the time of chemical ripening, more preferably within 20% of the chemical ripening time).

The silver halide emulsion for use in the present invention is spectrally sensitized with a sensitizing dye.

The amount of sensitizing dyes added during the production of silver halide emulsion cannot be described uniformly according to the kinds of additives and the amount of silver halide, but the amount as added in conventional methods, that is, from 50% to 90% of saturated covering amount can be used.

That is, the preferred addition amount of sensitizing dyes is from 0.001 to 100 mmol, more preferably from 0.01 to 10 mmol, per mol of the silver halide.

Sensitizing dyes are added after chemical ripening or before chemical ripening. To the silver halide grains according to the present invention, sensitizing dyes are added most preferably during chemical ripening or before chemical ripening (for example, at the time of grain formation or before physical ripening).

Dyes which themselves do not have a spectral sensitizing function or materials which substantially do not absorb visible light but show supersensitization can be incorporated in the emulsion with sensitizing dyes. For example, aminostilbene compounds substituted with nitrogen-containing heterocyclic groups (e.g., those disclosed in U.S. Pat. Nos. 2,933,390 and 3,635,721), aromatic organic acid-formaldehyde condensation products (those disclosed in U.S. Pat. No. 3,743,510), cadmium salts or azaindene compounds may be contained in the emulsion. The combinations disclosed in U.S. Pat. Nos. 3,615,613, 3,615,641, 3,617,295 and 3,635,721 are particularly useful.

The silver halide emulsion of the present invention can contain surface and internal fogged light-insensitive silver halide emulsion in the same layer or different layers in combination.

The photographic emulsion of the present invention can be used in various color photographic materials such as color negative films for general and cinematographic uses, color reversal films for slide and television uses, color papers, color positive films, color reversal papers, color diffusion type photographic materials and heat developable color photographic materials, as representative examples.

The photographic material of the present invention is a multilayer color photographic material which comprises a support having provided thereon at least one silver halide emulsion layer and at least one-light-insensitive layer, and in many cases, at least two silver halide emulsion layers sensitive to light of substantially different wavelength regions, still more preferably a color image forming unit comprising a red-sensitive silver halide emulsion layer, a color image forming unit comprising a green-sensitive silver halide emulsion layer, and a color image forming unit comprising a blue-sensitive silver halide emulsion layer.

Further, the photographic material of the present invention contains in a silver halide emulsion layer at least one nondiffusion coupler which forms a dye by coupling with the oxidation product of an aromatic primary amine developing agent, preferably contains a blue-sensitive silver halide emulsion layer containing a yellow coupler, a green-sensitive silver halide emulsion layer containing a magenta coupler, and a red-sensitive silver halide emulsion layer containing a cyan coupler. The multilayer color photographic material of the present invention is processed with a bleaching solution or a bleach-fixing solution after exposure and development.

In the photographic material of the present invention, unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a light-sensitive layer having a different spectral sensitivity is interposed between layers having the same spectral sensitivity.

Light-insensitive layers such as various interlayers may be provided between the above-described silver halide light-sensitive layers, and on the uppermost layer and beneath the lowermost layer of the silver halide light-sensitive layers.

These light-insensitive layers may contain couplers, DIR compounds and color mixing preventives generally used as disclosed in JP-A-61-43748, JP-A-59-113438, JP-A-59-113440, JP-A-61-20037 and JP-A-61-20038. The thickness of the light-insensitive layer is preferably from 0.1 μm to 5 μm.

A plurality of silver halide emulsion layers comprising each unit light-sensitive layer extremely preferably comprise at least three layer constitution of a high sensitivity emulsion layer, a middle sensitivity emulsion layer and a low sensitivity emulsion layer.

The arrangement of this constitution is not particularly limited, and a layer nearer to the support may be a low sensitivity emulsion layer or may be a high sensitivity emulsion layer.

Further, for improving color reproducibility, a donor layer (CL: Color collection layer) for an interlayer effect having a different spectral sensitivity distribution from a main light-sensitive layer such as BL (Blue sensitive layer), GL (Green sensitive layer) and RL (Red sensitive layer) may preferably be provided adjacent or close to the main light-sensitive layer, as disclosed in U.S. Pat. Nos. 4,663,271, 4,705,744, 4,707,436, JP-A-62-160448 and JP-A-63-89850.

As above, various layer constitutions and arrangements can be selected according to the end purpose of each photographic material.

In the production of photographic materials of the present invention, in general, photographically useful substances are added to a photographic coating solution, that is, added to a hydrophilic colloid solution.

Photographic materials of the present invention are, in general, processed with an alkali developing solution containing a developing agent after imagewise exposure, and after this color development, color photographic materials are processed with a processing solution having a bleaching ability containing a bleaching agent and images are formed.

With respect to the silver halide photographic emulsion for use in the present invention, and various techniques and inorganic and organic materials which can be used in the silver halide photographic material using the silver halide photographic emulsion for use in the present invention, in general, those disclosed in *Research Disclosure,* Nos. 308119 (1989) and 37038 (1995) can be used.

In addition to these, more specifically, for example, techniques and inorganic and organic materials which can be used in the color photographic material to which the silver halide photographic emulsion for use in the present invention is applicable are disclosed in the following places of EP-A-436938 and the patents cited in the following.

| | |
|---|---|
| 1) Layer Structure | line 34, page 146 to line 25, page 147 |
| 2) Silver Halide Emulsion | line 26, page 147 to line 12, page 148 |
| 3) yellow Coupler | line 35, page 137 to line 33, page 146, lines 21 to 23, page 149 |
| 4) Magenta Coupler | lines 24 to 28, page 149; line 5, page 3 to line 55, page 25 of EP-A-421453 |
| 5) Cyan Coupler | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |
| 7) Colored Coupler | line 42, page 53 to line 34, page 137, lines 39 to 45, page 149 |
| 8) Other Functional | line 1, page 7 to line 41, page 53, |

-continued

| | |
|---|---|
| Coupler | line 46, page 149 to line 3 page 150; line 1, page 3 to line 50, page 29 of EP-A-435334 |
| 9) Preservative, Antibacterial Agent | lines 25 to 28, page 150 |
| 10) Formalin Scavenger | lines 15 to 17, page 149 |
| 11) Other Additives | lines 38 to 47, page 153; line 21, page 75 to line 56, page 84 of EP-A-421453, line 40, page 27 to line 40, page 37 of EP-A-421453 |
| 12) Dispersion Method | lines 4 to 24, page 150 |
| 13) Support | line 32 to 34, page 150 |
| 14) Film Thickness, Physical Properties of Film | lines 35 to 49, page 150 |
| 15) Color Development Process, Black-and-White Development Process, Fogging Process | line 50, page 150 to line 47, page 151; lines 11 to 54, page 34 of EP-A-442323; lines 14 to 22, page 35 of EP-A-442323 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The present invention will be illustrated in more detail with reference to the following examples, but these are not to be construed as limiting the invention.

EXAMPLE 1

Preparation of Sample No. 101

A multilayer color photographic material was prepared as Sample No. 101 by coating each layer having the following composition on an undercoated cellulose triacetate film support having the thickness of 127 μm. The numeral corresponding to each component indicates the addition amount per $m^2$. The function of the compounds added is not limited to the use described.

| | |
|---|---|
| **First Layer: Antihalation Layer** | |
| Black Colloidal Silver | 0.10 g |
| Gelatin | 1.90 g |
| Ultraviolet Absorber U-1 | 0.10 g |
| Ultraviolet Absorber U-3 | 0.040 g |
| Ultraviolet Absorber U-4 | 0.10 g |
| High Boiling Point Organic Solvent Oil-1 | 0.10 g |
| Microcrystal Solid Dispersion of Dye E-1 | 0.10 g |
| **Second Layer: Interlayer** | |
| Gelatin | 0.40 g |
| Compound Cpd-C | 5.0 mg |
| Compound Cpd-J | 5.0 mg |
| Compound Cpd-K | 3.0 mg |
| High Boiling Point Organic Solvent Oil-3 | 0.10 g |
| Dye D-4 | 0.80 mg |
| **Third Layer: Interlayer** | |
| Surface and Interior Fogged Fine Grain Silver Iodobromide Emulsion (average grain size: 0.06 μm, variation coefficient: 18%, AgI content: 1 mol %) | silver amount: 0.050 g |
| Yellow Colloidal Silver | silver amount: 0.030 g |
| Gelatin | 0.40 g |

-continued

| | |
|---|---|
| **Fourth Layer: Low Sensitivity Red-Sensitive Emulsion Layer** | |
| Emulsion A | silver amount: 0.30 g |
| Emulsion B | silver amount: 0.20 g |
| Gelatin | 0.80 g |
| Coupler C-1 | 0.15 g |
| Coupler C-2 | 0.050 g |
| Coupler C-3 | 0.050 g |
| Coupler C-9 | 0.050 g |
| Compound Cpd-C | 5.0 mg |
| Compound Cpd-J | 5.0 mg |
| High Boiling Point Organic Solvent Oil-2 | 0.10 g |
| Additive P-1 | 0.10 g |
| **Fifth Layer: Middle Sensitivity Red-Sensitive Emulsion Layer** | |
| Emulsion B | silver amount: 0.20 g |
| Emulsion C | silver amount: 0.30 g |
| Gelatin | 0.80 g |
| Coupler C-1 | 0.20 g |
| Coupler C-2 | 0.050 g |
| Coupler C-3 | 0.20 g |
| High Boiling Point Organic Solvent Oil-2 | 0.10 g |
| Additive P-1 | 0.10 g |
| **Sixth Layer: High Sensitivity Red-Sensitive Emulsion Layer** | |
| Emulsion D | silver amount: 0.40 g |
| Gelatin | 1.10 g |
| Coupler C-1 | 0.30 g |
| Coupler C-2 | 0.10 g |
| Coupler C-3 | 0.70 g |
| Additive P-1 | 0.10 g |
| **Seventh Layer: Interlayer** | |
| Gelatin | 0.60 g |
| Additive M-1 | 0.30 g |
| Color Mixing Preventive Cpd-I | 2.6 mg |
| Dye D-5 | 0.020 g |
| Dye D-6 | 0.010 g |
| Compound Cpd-J | 5.0 mg |
| High Boiling Point Organic Solvent Oil-1 | 0.020 g |
| **Eighth Layer: Interlayer** | |
| Surface and Interior Fogged Silver Iodobromide Emulsion (average grain size: 0.06 μm, variation coefficient: 16%, AgI content: 0.3 mol %) | silver amount: 0.020 g |
| Yellow Colloidal Silver | silver amount: 0.020 g |
| Gelatin | 1.00 g |
| Additive P-1 | 0.20 g |
| Color Mixing Preventive Cpd-A | 0.10 g |
| Compound Cpd-C | 0.10 g |
| **Ninth Layer: Low Sensitivity Green-Sensitive Emulsion Layer** | |
| One of: | |
| Emulsion E | silver amount: 0.10 g |
| Emulsion F | silver amount: 0.20 g |
| Emulsion G | silver amount: 0.20 g |
| Emulsion P | silver amount: 0.17 g |
| Emulsion Q | silver amount: 0.17 g |
| Emulsion R | silver amount: 0.17 g |
| and | |
| Emulsion Z | silver amount: 0.17 g |
| Emulsion a | silver amount: 0.17 g |
| Emulsion b | silver amount: 0.17 g |
| Gelatin | 0.50 g |
| Coupler C-4 | 0.10 g |
| Coupler C-7 | 0.050 g |
| Coupler C-8 | 0.10 g |
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High Boiling Point Organic Solvent Oil-1 | 0.10 g |
| High Boiling Point Organic Solvent Oil-2 | 0.10 g |

-continued

Tenth Layer: Middle Sensitivity Green-Sensitive Emulsion Layer

| | |
|---|---|
| One of: | |
| Emulsion G | silver amount: 0.30 g |
| Emulsion H | silver amount: 0.10 g |
| Emulsion R | silver amount: 0.40 g |
| and | |
| Emulsion Y | silver amount: 0.40 g |
| Gelatin | 0.60 g |
| Coupler C-4 | 0.070 g |
| Coupler C-7 | 0.050 g |
| Coupler C-8 | 0.050 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High Boiling Point Organic Solvent Oil-2 | 0.010 g |

Eleventh Layer: High Sensitivity Green-Sensitive Emulsion Layer

| | |
|---|---|
| Emulsion I | silver amount: 0.50 g |
| Gelatin | 1.00 g |
| Coupler C-4 | 0.20 g |
| Coupler C-7 | 0.10 g |
| Coupler C-8 | 0.050 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High Boiling Point Organic Solvent Oil-1 | 0.020 g |
| High Boiling Point Organic Solvent Oil-2 | 0.020 g |

Twelfth Layer: Interlayer

| | |
|---|---|
| Gelatin | 0.60 g |
| Compound Cpd-L | 0.050 g |
| High Boiling Point Organic Solvent Oil-1 | 0.050 g |

Thirteenth Layer: Yellow Filter Layer

| | |
|---|---|
| One of: | |
| Yellow Colloidal Silver | silver amount: 0.080 g |
| and | |
| Microcrystal Solid Dispersion of Dye E-2 | 0.06 g |
| Microcrystal Solid Dispersion of Dye E-3 | 0.04 g |
| Gelatin | 1.10 g |
| Color Mixing Preventive Cpd-A | 0.010 g |
| Compound Cpd-L | 0.010 g |
| High Boiling Point Organic Solvent Oil-1 | 0.010 g |

Fourteenth Layer: Interlayer

| | |
|---|---|
| Gelatin | 0.60 g |

Fifteenth Layer: Low Sensitivity Blue-Sensitive Emulsion Layer

| | |
|---|---|
| One of: | |
| Emulsion J | silver amount: 0.20 g |
| Emulsion K | silver amount: 0.30 g |
| Emulsion S | silver amount: 0.20 g |
| Emulsion T | silver amount: 0.30 g |
| and | |
| Emulsion V | silver amount: 0.20 g |
| Emulsion W | silver amount: 0.30 g |
| Gelatin | 0.80 g |
| Coupler C-5 | 0.20 g |
| Coupler C-6 | 0.10 g |
| Coupler C-10 | 0.40 g |

Sixteenth Layer: Middle Sensitivity Blue-Sensitive Emulsion Layer

| | |
|---|---|
| Emulsion L | silver amount: 0.30 g |
| Emulsion M | silver amount: 0.30 g |
| Gelatin | 0.90 g |
| Coupler C-5 | 0.10 g |
| Coupler C-6 | 0.10 g |
| Coupler C-10 | 0.60 g |

-continued

Seventeenth Layer: High Sensitivity Blue-sensitive Emulsion Layer

| | |
|---|---|
| Emulsion N | silver amount: 0.20 g |
| Emulsion O | silver amount: 0.20 g |
| Gdelatin | 1.20 g |
| Coupler C-5 | 0.10 g |
| Coupler C-6 | 0.10 g |
| Coupler C-10 | 0.60 g |
| High Boiling Point Organic Solvent Oil-2 | 0.10 g |

Eighteenth Layer: First Protective Layer

| | |
|---|---|
| Gelatin | 0.70 g |
| Ultraviolet Absorber U-1 | 0.20 g |
| Ultraviolet Absorber U-2 | 0.050 g |
| Ultraviolet Absorber U-5 | 0.30 g |
| Formalin Scavenger Cpd-H | 0.40 g |
| Dye D-1 | 0.15 g |
| Dye D-2 | 0.050 g |
| Dye D-3 | 0.10 g |

Nineteenth Layer: Second Protective Layer

| | |
|---|---|
| Colloidal Silver | silver amount: 0.10 mg |
| Fine Grain Silver Iodobromide Emulsion (average grain size: 0.06 μm, AgI content: 1 mol %) | silver amount: 0.10 g |
| Gelatin | 0.40 g |

Twentieth Layer: Third Protective Layer

| | |
|---|---|
| Gelatin | 0.40 g |
| Polymethyl Methacrylate (average particle size: 1.5 μm) | 0.10 g |
| Copolymer of Methyl Methacrylate/Acrylic Acid in Proportion of 4/6 (average particle size: 1.5 μm) | 0.10 g |
| Silicone Oil | 0.030 g |
| Surfactant W-1 | 3.0 mg |
| Surfactant W-2 | 0.030 g |

Further, Additives F-1 to F-8 were added to every emulsion layer in addition to the above components. Moreover, gelatin hardener H-1 and surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

Preparation of Dispersion of Organic Solid Dispersion Dye

Dye E-1 was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having 6% dye concentration. Next, 1,700 ml of zirconia beads having an average diameter of 0.5 mm were filled in an ultravisco mill (UVM-2) manufactured by Imex Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersions of Dyes E-2 and E-3 were obtained in the same manner. The average grain sizes of fine grains of Dyes E-2 and E-3 were 0.54 μm and 0.56 μm, respectively.

TABLE 1

The Silver Iodobromide Emulsions Used in Sample No. 101

| Emulsion Name | Characteristics of Grain | Equivalent-Sphere Average Grain Size (μm) | Variation Coefficient (%) | Silver Iodide Content (%) |
|---|---|---|---|---|
| A | Monodisperse tetradecahedral grains | 0.28 | 6 | 4.0 |
| B | Monodisperse cubic internal latent image type grains | 0.30 | 10 | 4.0 |
| C | Monodisperse cubic grains | 0.38 | 10 | 5.0 |
| D | Monodisperse tabular grains (average aspect ratio: 3.0) | 0.68 | 8 | 2.0 |
| E | Monodisperse cubic grains | 0.20 | 17 | 4.0 |
| F | Monodisperse cubic grains | 0.25 | 16 | 4.0 |
| G | Monodisperse cubic grains | 0.40 | 11 | 4.0 |
| H | Monodisperse cubic grains | 0.50 | 9 | 3.5 |
| I | Monodisperse tabular grains (average aspect ratio: 5.0) | 0.80 | 10 | 2.0 |
| J | Monodisperse cubic grains | 0.30 | 18 | 4.0 |
| K | Monodisperse cubic grains | 0.45 | 17 | 4.0 |
| L | Mondisperse tabular grains (average aspect ratio: 5.0) | 0.55 | 10 | 2.0 |
| M | Monodisperse tabular grains (average aspect ratio: 8.0) | 0.70 | 13 | 2.0 |
| N | Monodisperse tabular grains (average aspect ratio: 6.0) | 1.00 | 10 | 1.5 |
| O | Monodisperse tabular grains (average aspect ratio: 9.0) | 1.20 | 15 | 1.5 |
| P | Monodisperse tabular grains (average aspect ratio: 5.0) | 0.22 | 19 | 4.0 |
| Q | Monodisperse tabular grains (average aspect ratio: 5.0) | 0.33 | 18 | 4.0 |
| R | Monodisperse tabular grains (average aspect ratio: 5.0) | 0.44 | 18 | 3.5 |
| S | Monodisperse tabular grains (average aspect ratio: 5.0) | 0.22 | 19 | 4.0 |
| T | Monodisperse tabular grains (average aspect ratio: 5.0) | 0.33 | 18 | 4.0 |
| U | Cubic grains | 1.0 | 13 | 2.0 |
| V | Monodisperse tabular grains (average aspect ratio: 5.0) | 0.22 | 19 | 4.0 |
| W | Monodisperse tabular grains (average aspect ratio: 5.0) | 0.33 | 18 | 4.0 |
| X | Monodisperse tabular grains (average aspect ratio: 5.0) | 0.80 | 10 | 2.0 |
| Y | Monodisperse tabular grains (average aspect ratio: 5.0) | 0.44 | 18 | 3.5 |
| Z | Monodisperse tabular grains (average aspect ratio: 5.0) | 0.22 | 19 | 4.0 |
| a | Monodisperse tabular grains (average aspect ratio: 5.0) | 0.33 | 18 | 4.0 |
| b | Monodisperse tabular grains (average aspect ratio: 5.0) | 0.44 | 18 | 3.5 |

Note:
In tabular grains of Emulsions D, I, L, M, N, O to T, 10 or more dislocations lines per one grain as disclosed in JP-A-3-237450 were observed with a high pressure electron microscope. On the other hand, dislocation lines were not observed in the grains in Emulsions V to Z and a to b.

TABLE 2

Spectral Sensitization of Emulsions A to b

| Emulsion Name | Sensitizing Dye Added | Addition Amount per Mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |

TABLE 2-continued

Spectral Sensitization of Emulsions A to b

| Emulsion Name | Sensitizing Dye Added | Addition Amount per Mol of Silver Halide (g) |
|---|---|---|
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |

TABLE 2-continued

Spectral Sensitization of Emulsions A to b

| Emulsion Name | Sensitizing Dye Added | Addition Amount per Mol of Silver Halide (g) |
|---|---|---|
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 3

| Emulsion Name | Sensitizing Dye Added | Addition Amount per Mol of Silver Halide (g) |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |
| P | S-4 | 1.1 |

TABLE 3-continued

| Emulsion Name | Sensitizing Dye Added | Addition Amount per Mol of Silver Halide (g) |
|---|---|---|
| | S-5 | 0.25 |
| | S-9 | 0.36 |
| Q | S-4 | 0.73 |
| | S-5 | 0.17 |
| | S-9 | 0.24 |
| R | S-4 | 0.55 |
| | S-5 | 0.13 |
| | S-9 | 0.18 |
| S | S-6 | 0.15 |
| | S-7 | 0.55 |
| T | S-6 | 0.1 |
| | S-7 | 0.37 |
| U | S-4 | 0.10 |
| | S-5 | 0.02 |
| | S-9 | 0.02 |
| V | S-6 | 0.15 |
| | S-7 | 0.55 |
| W | S-6 | 0.1 |
| | S-7 | 0.37 |
| X | S-4 | 0.30 |
| | S-5 | 0.07 |
| Y | S-4 | 0.55 |
| | S-5 | 0.13 |
| | S-9 | 0.18 |
| Z | S-4 | 1.1 |
| | S-5 | 0.25 |
| | S-9 | 0.36 |
| a | S-4 | 0.73 |
| | S-5 | 0.17 |
| | S-9 | 0.24 |
| b | S-4 | 0.55 |
| | S-5 | 0.13 |
| | S-9 | 0.18 |

C-1

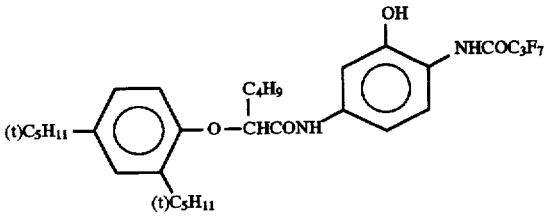

C-2

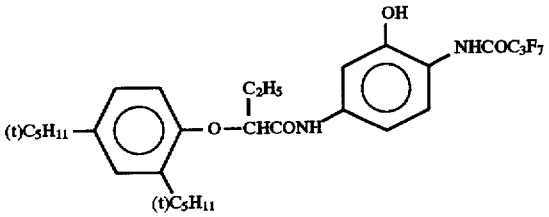

C-3

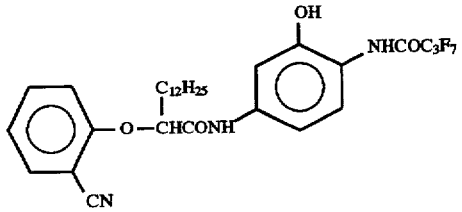

-continued
C-4
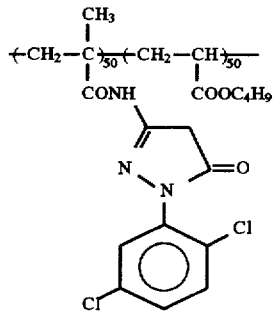
numerals indicate wt %
average molecular weight:
about 25,000
C-5
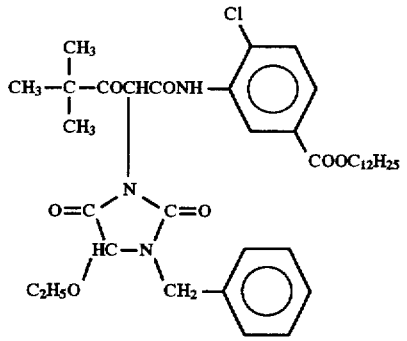
C-6
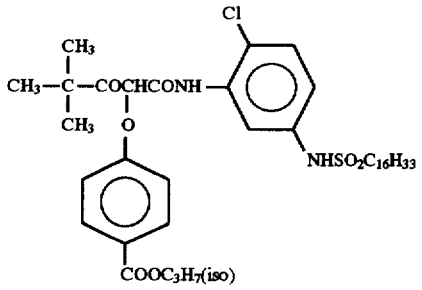
C-7
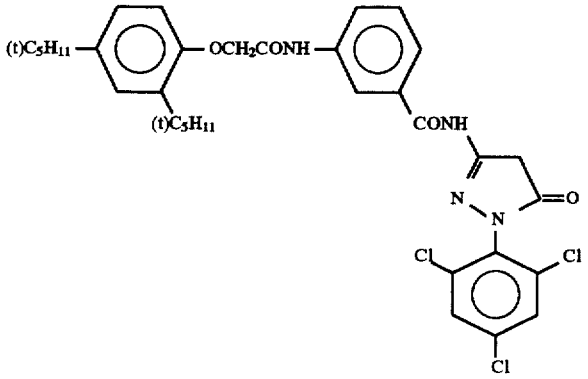

-continued
C-8
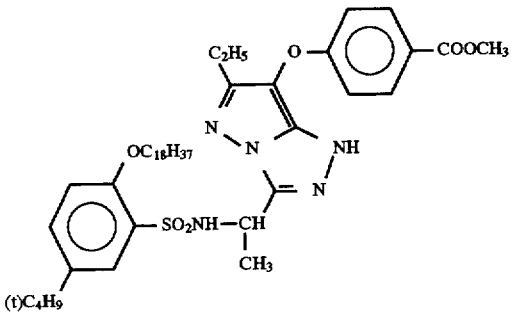
C-9
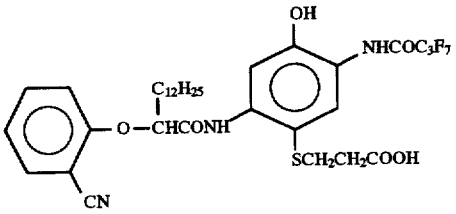
C-10
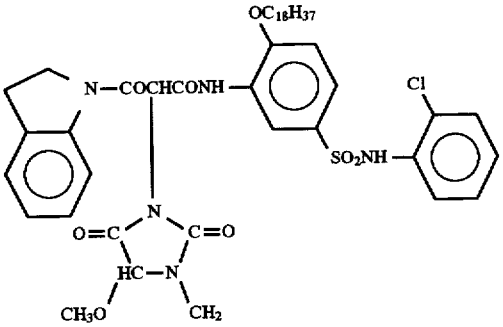
Oil-1
Dibutyl Phthalate
Oil-2
Tricresyl Phosphate
Oil-3
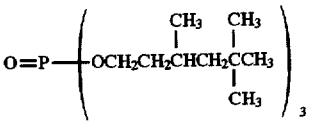
Cpd-A
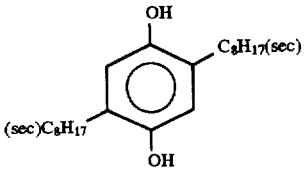

-continued
Cpd-B
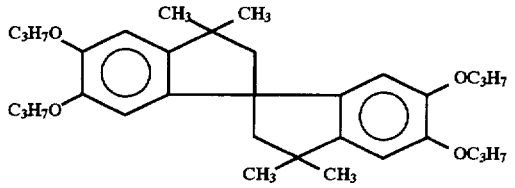
Cpd-C
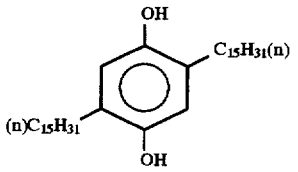
Cpd-D
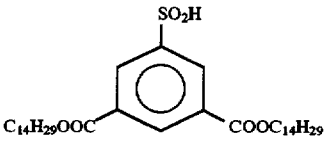
Cpd-E
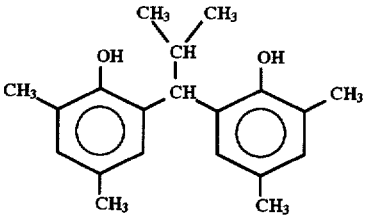
Cpd-F
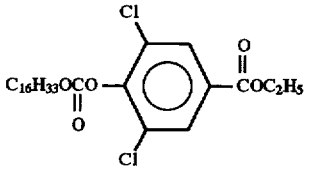
Cpd-H
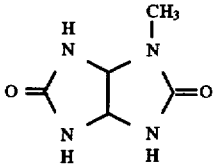
Cpd-I
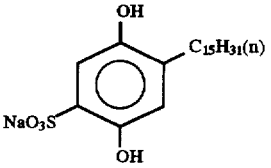

-continued
Cpd-J
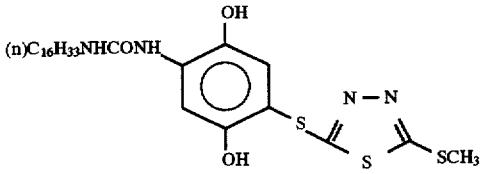
Cpd-K
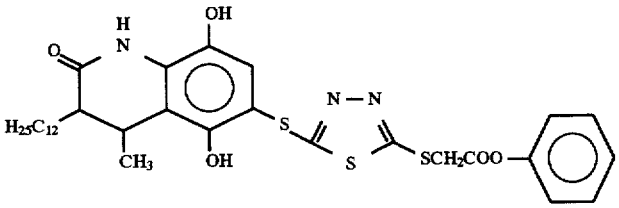
Cpd-L
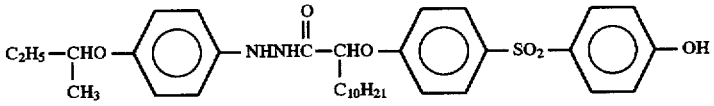
U-1
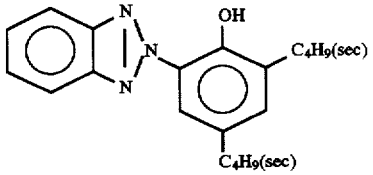
U-2
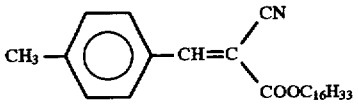
U-3
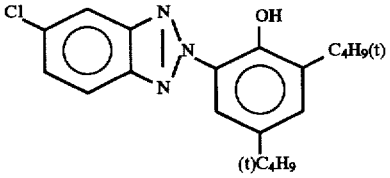
U-4
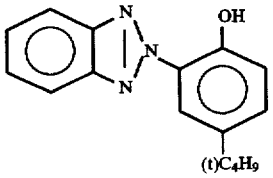

-continued
U-5
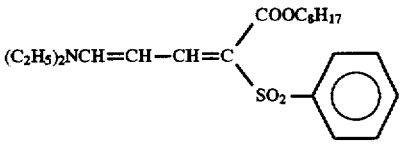
S-1
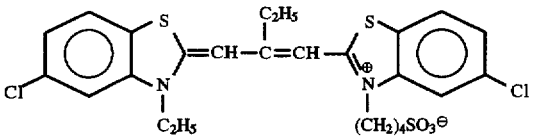
S-2
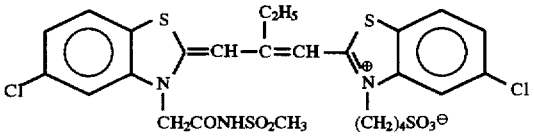
S-3
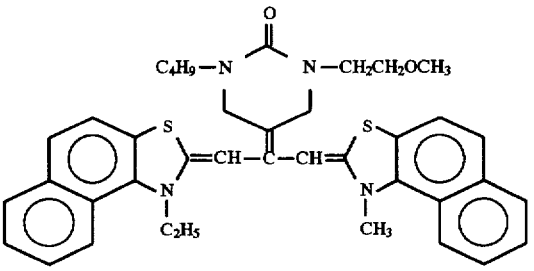
S-4
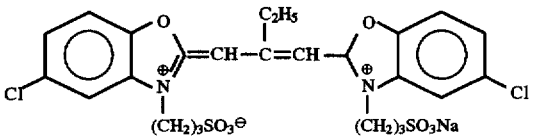
S-5
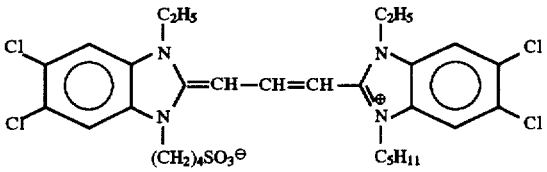
S-6
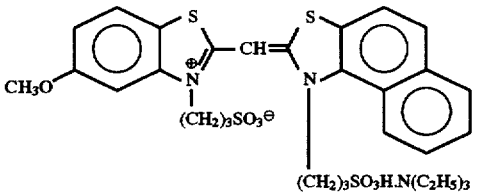
S-7
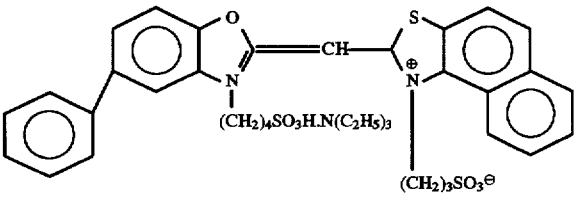

-continued
S-8
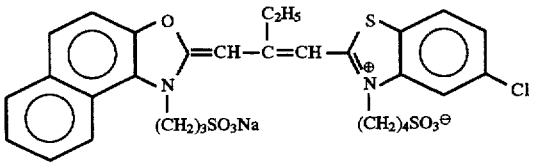
S-9
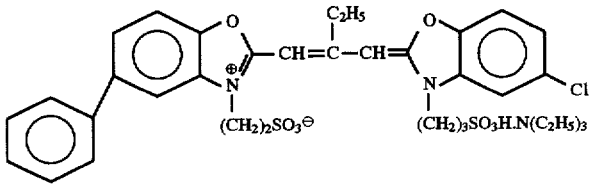
D-1
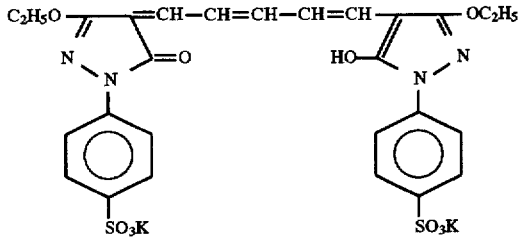
D-2
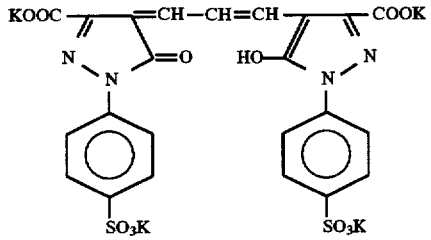
D-3
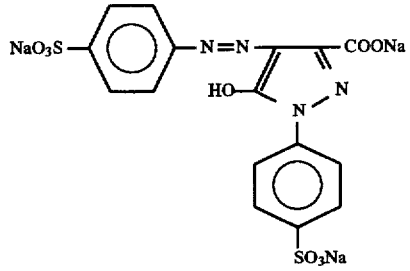
D-4
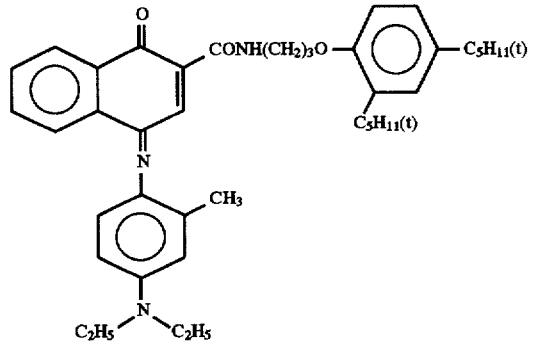

-continued
D-5
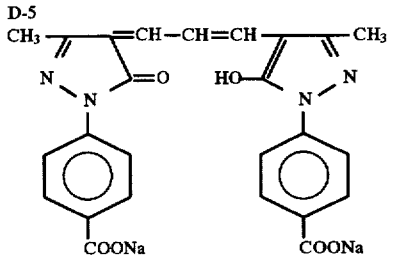
D-6
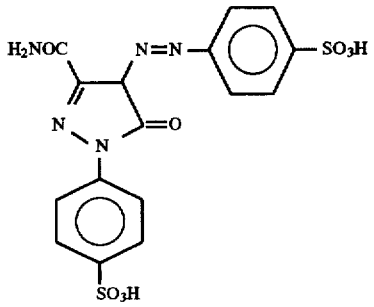
E-1
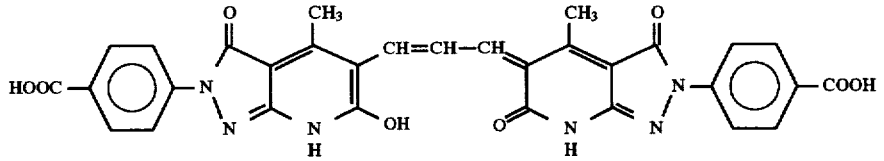
E-2
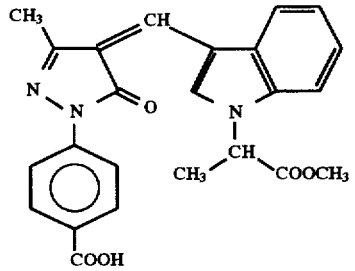
E-3
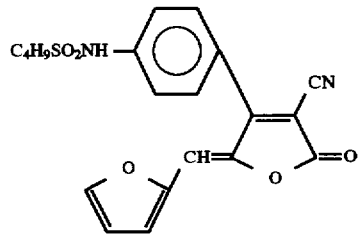
H-1
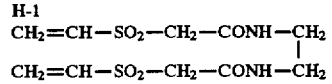
W-1
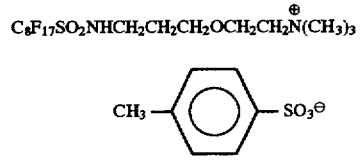

-continued
W-2
$C_8F_{17}SO_2N(C_3H_7)CH_2COOK$
W-3
$NaO_3S-CH(CH_2COOCH_2CH(C_2H_5)C_4H_9)COOCH_2CH(C_2H_5)C_4H_9$
W-4
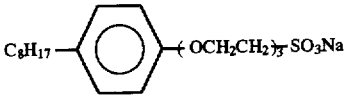
W-5
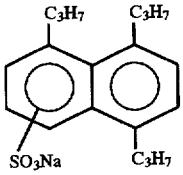
W-6
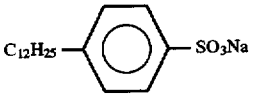
P-1
$-(CH_2-CH(CONHC_4H_9(t))-)_n-$
M-1
$-(CH_2-CH(COOC_4H_9)-)_n-$
F-1
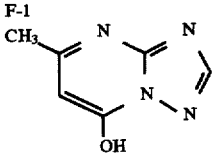
F-2
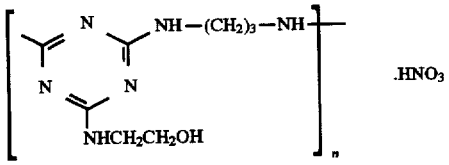
$.HNO_3$
(n = 3~4)
F-3
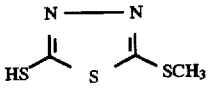
F-4
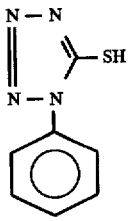

-continued

F-5

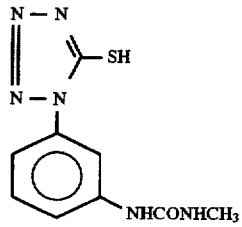

F-6

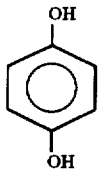

F-5

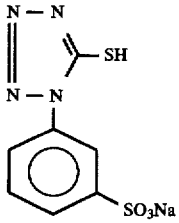

F-8

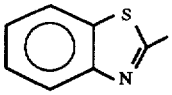

Sample Nos. 101 to 108 were prepared using the emulsions in the ninth, tenth, eleventh and fifteenth shown in Table 4, the presence or absence of the twelfth and fourteenth layers, and the presence or absence of yellow colloidal silver also shown in Table 4.

TABLE 4

| Sample No. | Layer 15 (Bu) Used Emulsion | Layer 11 (Go) Used Emulsion | Layer 10 (Gm) Used Emulsion | Layer 9 (Gu) Used Emulsion | Bo/Bm/Bu Grain Form | Go/Gm/Gu Grain Form | Presence or Absence of Layers 12 & 14 | Use of Colloidal Silver in Layer 13 | Remarks |
|---|---|---|---|---|---|---|---|---|---|
| 101 | J/K | U | G/H | E/F/G | t/t/c | c/c/c | absent | yes | Comparison |
| 102 | S/T | U | G/H | E/F/G | t/t/t | c/c/c | absent | yes | Comparison |
| 103 | S/T | I | R | P/Q/R | t/t/t | t/t/t | absent | yes | Comparison |
| 104 | S/T | I | R | P/Q/R | t/t/t | t/t/t | present | no | Comparison |
| 105 | S/T | I | R | P/Q/R | t/t/t | t/t/t | present | yes | Invention |
| 106 | J/K | U | G/H | E/F/G | t/t/c | c/c/c | present | yes | Comparison |
| 107 | V/W | X | Y | Z/a/b | t/t/t | t/t/t | present | yes | Comparison |
| 108 | S/T | I | G/H | P/Q/R | t/t/t | t/c/c | present | yes | Invention |

In columns of "Grain Form", "t" and "c" represent tabular and cubic, respectively.
When the column "Layers 12 & 14" is "absent", the amount of gelatin in the thirteenth layer was increased and the total film thickness is adjusted to be the same when "Layers 12 & 14" is "present".
When colloidal silver was not used in thirteenth layer, microcrystal solid dispersions of Dye E-2 and E-3 were used.
Bo represents seventeenth layer and Bm represents sixteenth layer.

The following experiment was conducted by exposing Sample Nos. 101 to 108 with a color temperature 4,800° K white light source for 1/50 seconds.

For the purpose of obtaining sharpness of each sample, exposure was conducted by contacting rectangular pattern vapor deposited on a glass substrate having density difference of 0.5 by changing spatial frequency and color development was carried out according to the following Standard processing step and standard processing solution. Exposure was conducted with a green filter. The density of the obtained rectangular image was precisely measured with a microdensitometer and found out spatial frequency required to provide CTF value of 0.5 and this value was criterion of sharpness.

Further, for examining incubation resisting capability of each sample obtained, each sample stored at 50° C., 30% RH, 55% RH and 80% RH for 1 month and each sample stored in a freezer were subjected to wedgewise exposure at 2,000 lux for 1/50 sec. at the same time and development processed according to the following processing step. Incubation capability at Dmax part was estimated from the variation of maximum density of magenta color density and yellow color density at this time. Further, relative sensitivity was estimated and evaluated from the point of magenta color density 2.0. A standard processing step and a standard processing solution are shown below.

Standard Processing Step

| Processing Step | Processing Time (min) | Processing Temperature (°C.) | Tank Capacity (liter) | Replenishing Rate (ml/m²) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second Washing | 4 | 38 | 8 | 7,500 |
| Stabilizing | 1 | 25 | 2 | 1,100 |

The composition of each processing solution used was as follows.

| | Tank Solution | Replenisher |
|---|---|---|
| First Developing Solution | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinone-monosulfonate | 20 g | 20 g |
| Potassium Carbonate | 15 g | 15 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |
| Reversal Solution | | |
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 2.0 g |
| Sodium Sulfite | 7.0 g | 7.0 g |
| Trisodium Phosphate 12 Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline.3/2 Sulfate. Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |
| Pre-bleaching Solution | | |
| Disodium Ethylenediamine-tetraacetae Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic or sodium hydroxide) | 6.30 | 6.10 |
| Bleaching Solution | | |
| Disodium Ethylenediamine-tetraacetate Dihydrate | 2.0 g | 4.0 g |
| Ammonium Ethylenediamine-tetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |
| Fixing Solution | | |
| Ammonium Thiosulfate | 80 g | same as the tank solution |
| Sodium Sulfite | 5.0 g | same as the tank solution |
| Sodium Bisulfite | 5.0 g | same as the tank solution |
| Water to make | 1,000 ml | |
| pH (adjusted with acetic acid or aqueous ammonia) | 6.60 | |
| Stabilizing Solution | | |
| 1,2-Benzisothiazolin-3-one | 0.02 g | 0.03 g |
| Polyoxyethylene-p-monononyl-phenyl Ether (average polymerizaiton degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

Further, rapid processing with a reduced replenishing rate was conducted according to the following processing step and yellow density of unexposed part was measured.

Rapid processing suitability with a reduced replenishing rate was examined by comparing with yellow density of unexposed part of the sample processed by a standard processing.

After the silver halide color photographic material was exposed, the sample was processed with an automatic processor according to the following processing step until the accumulated replenishing rate of the solution reached three times of that tank capacity.

| Processing Step | Processing Time (min) | Processing Temperature (°C.) | Tank Capacity (liter) | Replenishment Rate (ml/m²) |
|---|---|---|---|---|
| First Development | 4 | 38 | 12 | 1,000 |
| First Washing | 45 sec. | 38 | 2 | 2,200 |
| Reversal | 45 sec. | 38 | 2 | 500 |

-continued

| Processing Step | Processing Time (min) | Processing Temperature (°C.) | Tank Capacity (liter) | Replenishment Rate (ml/m²) |
|---|---|---|---|---|
| Color Development | 4 | 38 | 12 | 1,000 |
| Bleaching | 3 | 38 | 4 | 200 |
| Fixing | 3 | 38 | 8 | 500 |
| Second Washing (1) | 1 | 38 | 2 | — |
| Second Washing (2) | 1 | 38 | 2 | 1,100 |
| Stabilization | 1 | 25 | 2 | 500 |
| Drying | 1 | 65 | — | — |

Replenishment of the second washing was conducted in a countercurrent system by introducing the replenisher into second washing (2) and introducing the overflow from second washing (2) into second washing (1).

| First Developing Solution | Tank Solution | Replenisher |
|---|---|---|
| Pentasodium Nitrilo-N,N,N-trimethylenephosphonate | 2.0 g | 3.0 g |
| Sodium Sulfite | 30 g | 40 g |
| Potassium Hydroquinone Monosulfonate | 30 g | 40 g |
| Potassium Carbonate | 40 g | 48 g |
| 1-Phenyl-4-methyl-4-hydroxymethyl-3-pyrazolidone | 2.0 g | 3.5 g |
| Potassium Bromide | 2.5 g | 0 g |
| Potassium Thiocyanate | 1.2 g | 1.8 g |
| Potassium Iodide | 2.0 mg | — |
| Water to make | 1,000 ml | 1,000 ml |
| pH (adjusted with sulfuric acid or potassium hydroxide) | 10.00 | 10.20 |
| First Washing Water | | |
| Ethylenediaminetetramethylene-phosphonic Acid | 2.0 g | Replenisher equals tank solution |
| Disodium Phosphate | 5.0 g | |
| Water to make | 1,000 ml | |
| pH (adjusted with hydrochloric acid or sodium hydroxide) | 7.00 | |
| Reversal Solution | | |
| Pentasodium Nitrilo-N,N,N-trimethylenephosphonate | 3.0 g | Replenisher equals tank solution |
| Stannous Chloride.Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 3.0 g |
| Sodium Sulfite | 7.0 g | 10.0 g |
| Trisodium Phosphate.Dodecahydrate | 40 g | 45 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |

-continued

| First Developing Solution | Tank Solution | Replenisher |
|---|---|---|
| N-Ethyl-N-(β-methanesulfonamido-ethyl)-3-methyl-4-aminoaniline. ½ Sulfate.Monohydrate | 15 g | 20 g |
| 3,6-dithiaoctane-1,8-diol | 1.0 g | 1.2 g |
| Water to make | 1,000 ml | 1,000 ml |
| pH (adjusted with sulfuric acid or potassium hydroxide) | 12.00 | 12.20 |
| Bleaching Solution | | |
| Ammonium 1,3-Diaminepropane-tetraacetato Ferrate Monohydrate | 50 g | 100 g |
| Potassium Bromide | 100 g | 200 g |
| Ammonium Nitrate | 10 g | 20 g |
| Acetic Acid (90%) | 60 g | 120 g |
| 3-Mercapto-1,2,4-triazole | 0.0005 mol | 0.0008 mol |
| Water to make | 1,000 ml | 1,000 ml |
| pH (adjusted with nitric acid or aqueous ammonia) | 4.5 | 4.0 |
| Fixing Solution | | |
| Disodium Ethylenediamine-tetraacetate Dihydrate | 10.0 g | 15.0 g |
| Ammonium Thiosulfate | 150 g | 200 g |
| Sodium Sulfite | 25.0 g | 30.0 g |
| Water to make | 1,000 ml | 1,000 ml |
| pH (adjusted with acetic acid or aqueous ammonia) | 6.60 | 6.80 |

Second Washing Water (tank solution and replenisher are equal)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 1.5 g/liter of sodium sulfate were added thereto. The pH of this washing water was in the range of from 6.5 to 7.5.

| Stabilizing Solution | Tank Solution | Replenisher |
|---|---|---|
| 1-Hydroxymethyl-1,2,4-triazole | 2.3 g | Replenisher equals tank solution |
| Polyoxyethylene-p-monononylphenyl Ether (average polymerization degree: 10) | 0.3 g | |
| 1,2,4-Triazole | 2.0 g | |
| 1,4-Bis(1,2,4-triazol-1-ylmethyl)-piperazine | 0.2 g | |
| 1,2-Benzisothiazoline-3-one | 0.05 g | |
| Water to make | 1,000 ml | |
| pH (adjusted with sodium hydroxide and acetic acid) | 6.5 | |

The results obtained are shown in Table 5.

TABLE 5

| Sample No. | Incubation Resisting Capability (Dmax) 50° C. 30% RH | 50° C. 55% RH | 50° C. 80% RH | Incubation Resisting Capability (sensitivity) 50° C. 30% RH | 50° C. 55% RH | 50° C. 80% RH | Rapid Processing Suitability with Reduced Replenishing Rate | Sharpness | Remarks |
|---|---|---|---|---|---|---|---|---|---|
| 101 | 100 | 100 | 100 | 100 | 100 | 100 | ○ | 100 | Comparison |
| 102 | 120 | 130 | 150 | 100 | 100 | 100 | ○ | 120 | Comparison |
| 103 | 140 | 150 | 170 | 100 | 100 | 100 | ○ | 170 | Comparison |
| 104 | 140 | 150 | 170 | 70 | 50 | 30 | x | 170 | Comparison |
| 105 | 80 | 80 | 80 | 100 | 100 | 100 | ○ | 160 | Invention |
| 106 | 80 | 80 | 80 | 100 | 100 | 100 | ○ | 60 | Comparison |
| 107 | 100 | 100 | 100 | 80 | 70 | 60 | ○ | 160 | Comparison |
| 108 | 85 | 85 | 85 | 100 | 100 | 100 | ○ | 150 | Invention |

Above items are all expressed in relative values taking the value of Sample No. 101 as 100.
"Incubation Resisting Capability (Dmax)" shows the reduction degree of Dmax. The larger the value, the larger is the reduction degree.
In the item "Incubation Resisting Capability (sensitivity)", the larger the value, the larger is the sensitivity.
In the item "Sharpness", the larger the value, the more excellent is the sharpness.
In the item "Rapid Processing Suitability with Reduced Replenishing Rate", "○" means no change was observed with yellow density when compared with the sample processed according to standard processing, similarly "x" means that change was observed.

From the comparison of Sample No. 101 and 102, it can be seen that sharpness is improved when tabular grains are used in the fifteenth layer. Further, from the comparison of Sample No. 102 and 103, sharpness conspicuously increases when tabular grains are also used in the ninth layer to the eleventh layer. However Sample Nos. 102 and 103 which do not have the twelfth layer and the fourteenth layer are deteriorated in fog with the lapse of time compared with Sample No. 101 in which cubic grains were used. Sample No. 105 of the present invention having the twelfth layer and the fourteenth layer are excellent in incubation resisting capability while maintaining superior sharpness. On the other hand, in Sample No. 104, in which solid dispersion of a dye was used, yellow density increased due to decoloring failure when rapid processing with a reduced replenishing rate was conducted, therefore, it can be seen that not only photographic capabilities are impaired largely but also sensitivity reduction is caused with aging. In Sample No. 107 in which tabular grains having no dislocation lines were used, sensitivity reduction due to incubation is large. Further, only a reduction of sharpness is seen in Sample No. 106 having the twelfth layer and the fourteenth layer compared with Sample No. 101 containing cubic grains. From this fact, in the embodiment of the present invention using tabular grains having dislocation lines, the twelfth layer and the fourteenth layer are very effective for the improvement of photographic capabilities.

EXAMPLE 2

Sample Nos. 201 to 204 were prepared having different film thicknesses as shown in Table 6 by changing the amount of gelatin in the twelfth layer to the twentieth layer in Sample No. 106 in Example 1. Similarly Sample Nos. 205 to were prepared having different film thicknesses as shown in Table 6 by changing the amount of gelatin in the twelfth layer to the twentieth layer in Sample No. 105.

Evaluation of sharpness was conducted in the same manner as in Example 1. The results obtained are shown in Table 6.

TABLE 6

| Sample No. | Film Thickness of Layer 12 to Layer 20 (μm) | Sharpness | Remarks |
|---|---|---|---|
| 106 | 11.0 | 60 | Comparison |
| 201 | 10.5 | 58 | Comparison |
| 202 | 10.0 | 56 | Comparison |
| 203 | 9.5 | 54 | Comparison |
| 204 | 9.0 | 52 | Comparison |
| 105 | 11.0 | 160 | Invention |
| 205 | 10.5 | 165 | Invention |
| 206 | 10.0 | 200 | Invention |
| 207 | 9.5 | 203 | Invention |
| 208 | 9.0 | 206 | Invention |

In Sample Nos. 106, 201 to 204, when the film thickness is reduced little by little, sharpness is improved little by little. On the contrary, in samples of the present invention, when the film thickness is 10 μm or less, sharpness is drastically improved. It is understood that suppressing the film thickness of the twelfth layer to the twentieth layer to 10 μm or less is particularly preferred in the present invention.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having provided thereon a plurality of light-sensitive layers having different spectral sensitivities, wherein two nearest light-sensitive layers interposing a light-insensitive layer containing colloidal silver each contains in the proportion of 50% or more, in terms of the projected area, of tabular grains having (i) an aspect ratio of from 3 to 100 and (ii) 10 or more dislocation lines per one grain, and a light-insensitive layer is provided between each of said two nearest light-sensitive layers and said light-insensitive layer containing colloidal silver.

2. The silver halide color photographic material as claimed in claim 1, wherein said light-insensitive layer containing colloidal silver is a filter layer which absorbs the light having a wavelength of 450 nm or less.

3. The silver halide color photographic material as claimed in claim 2, wherein any light-sensitive layer farther from the support than said light-insensitive layer containing colloidal silver contains in the proportion of 50% or more, in terms of the projected area, of tabular grains having (i) an aspect ratio of from 3 to 100 and (ii) 10 or more dislocation lines per one grain.

4. The silver halide color photographic material as claimed in claim 3, wherein the total film thickness of any light-sensitive layer and light-insensitive layer farther from the support than said light-insensitive layer containing colloidal silver is 10 μm or less.

5. The silver halide color photographic material as claimed in claim 3, wherein the total film thickness of any light-sensitive layer and light-insensitive layer farther from the support than said light-insensitive layer containing colloidal silver is 3 μm to 10 μm.

6. The silver halide color photographic material as claimed in claim 1, wherein said tabular grains are monodisperse tabular grains.

7. The silver halide color photographic material as claimed in claim 1, wherein said tabular grains have an average silver iodide content of 5% or less.

* * * * *